US005671957A

United States Patent [19]

Raffini

[11] Patent Number: 5,671,957

[45] Date of Patent: Sep. 30, 1997

[54] CHILD RESISTANT TUBE LATCH

[76] Inventor: Roger Raffini, 10 Sunset Hill Rd., Georgetown, Conn. 06829

[21] Appl. No.: 572,713

[22] Filed: Dec. 14, 1995

[51] Int. Cl.[6] ..... E05C 5/02

[52] U.S. Cl. ..... 292/62; 292/60; 292/DIG. 37

[58] Field of Search ..... 292/60, 62, 121, 292/163, DIG. 37, DIG. 65

[56] References Cited

U.S. PATENT DOCUMENTS

| | | | |
|---|---|---|---|
| 767,567 | 8/1904 | Keil | 292/DIG. 37 X |
| 2,670,981 | 3/1954 | Wenham | 292/DIG. 37 X |
| 2,708,845 | 5/1955 | Trammell, Jr. | 292/DIG. 65 X |
| 2,922,297 | 1/1960 | Hitzelberger | 70/144 |
| 3,406,995 | 10/1968 | McCarthy | 292/173 X |
| 4,061,369 | 12/1977 | Palmer et al. | 292/163 |
| 4,133,142 | 1/1979 | Dzus, Jr. | 292/DIG. 37 X |
| 4,202,570 | 5/1980 | Riggins | 292/60 |
| 4,226,101 | 10/1980 | Lee | 70/78 |
| 4,416,477 | 11/1983 | Bialobrzeski et al. | 292/DIG. 38 X |
| 4,715,628 | 12/1987 | Brink et al. | 292/19 |
| 4,837,975 | 6/1989 | Simpson | 49/175 |
| 5,096,240 | 3/1992 | Schultz | 292/153 |
| 5,147,099 | 9/1992 | McLinden et al. | 292/175 |
| 5,280,974 | 1/1994 | Weintroub | 292/164 |
| 5,344,226 | 9/1994 | Lee | 312/334.47 |
| 5,425,560 | 6/1995 | Andersen et al. | 292/163 |

*Primary Examiner*—Rodney M. Lindsey
*Assistant Examiner*—Monica E. Millner
*Attorney, Agent, or Firm*—Richard C. Litman

[57] ABSTRACT

A child safety latch which cannot be actuated by those having relatively short fingers. A spring-biased lock is slidably moved within the J-shaped tracks of a guard tube. The latch is in an unlocked position when the locking pin rests in the larger side of the J-shaped track. In this position, the spring biases the locking pin against the top of the larger side of the track. Actuation of the latch, i.e. pushing down on the button located on top of the lock, lowers the lock against the spring. The complete lowering of the lock and the full compression of the spring occurs when the locking pin is at the bottom of the J-shaped track. A slight counter-clockwise twist of the finger urges the locking pin into the smaller side of the J-shaped track, where the lock is spring biased against the top of the smaller side. Thus, the lock is in a locked position and can only be opened by someone having fingers long enough to reach into the tube and to disengage the lock, by depressing the actuation means and rotating it in a clockwise direction.

13 Claims, 2 Drawing Sheets

CHILD RESISTANT TUBE LATCH

BACKGROUND OF THE INVENTION

1. Field of the Invention

The present invention relates to a child resistant latch which includes a lock in a guard tube.

2. Description of the Prior Art

The present invention relates to a child resistant tube latch. The latch is spring biased and includes a lock inside of a guard tube. Thus, children, who have relatively short fingers, cannot lock and unlock the latch. The latch can be used to secure objects such as cabinets, drawers, or any other areas in which it is desired to prevent the access of children.

Following are previously patented inventions which disclose features related to the invention.

U.S. Pat. No. 4,061,369, issued on Dec. 6, 1977 to John P. Palmer et al., teaches a catch in which a plunger having a detent which allows the plunger to slide along slots in a guide member.

U.S. Pat. Nos. 4,715,628, issued on Dec. 29, 1987 to Satya S. Brink et al., 5,280,974, issued on Jan. 25, 1994 to Etienne L. Weintroub, 5,344,226, issued on Sep. 6, 1994 to Wen-Ting Lee, teach safety latches. None of these latches are based on the principle of restricting access to the latches by having a guard tube. Further, the latch shown in the Brink et al. patent contains two pares. These two parts must be separately installed in a certain relationship, making installation difficult relative to that of the single component of the instant invention.

Other patents, an example of which is U.S. Pat. No. 2,922,297, issued on Jan. 26, 1960 to Erwin Hitzelberger, teach spring biased latches inside of housings.

None of the above inventions and patents, taken either singly or in combination, is seen to describe the instant invention as claimed.

SUMMARY OF THE INVENTION

The instant invention relates to a child safety latch which cannot be actuated by those having relatively short fingers. A spring-biased lock is slidably moved within a guard tube. In the unlocked position, an actuation means on the lock is near one end of the guard tube. However, when the lock is moved to the locked position, the actuation means is in the tube beyond the reach of a child.

Accordingly, it is a principal object of the invention to provide a child resistant latch.

It is another object of the invention to provide a latch that is easily usable by taking advantage of a physical trait unique to adults, namely long fingers.

Still another object of the invention is to provide a latch that can be easily installed, as only one piece needs to be installed.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

The unseen tracks, locking pins, and button are shown in broken lines throughout the figures. Similar reference characters denote corresponding features consistently throughout the attached figures.

DETAILED DESCRIPTION OF THE PREFERRED EMBODIMENT

Figure 1:
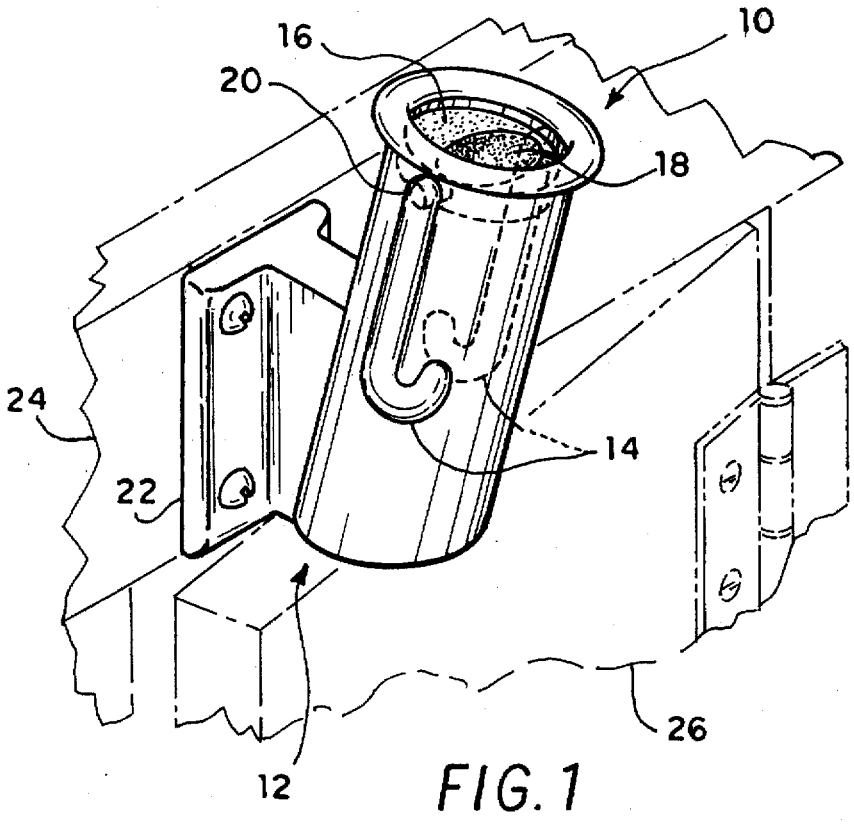
FIG. 1 is an environmental perspective view of the child resistant tube latch in an unlocked position.

The present invention relates to a child resistant latch 10. As seen in FIG. 1, the invention includes a guard tube 12 having a pair of J-shaped locking pin guides 14, 14 molded into it, one on each side. The guard tube 12 is mounted to an exterior cabinet surface 24 adjacent a drawer or a door by a mounting bracket 22. The guard tube 12 is mounted at an angle so that it can clear a counter top 36 (seen in FIGS. 2–4).

Figure 2:
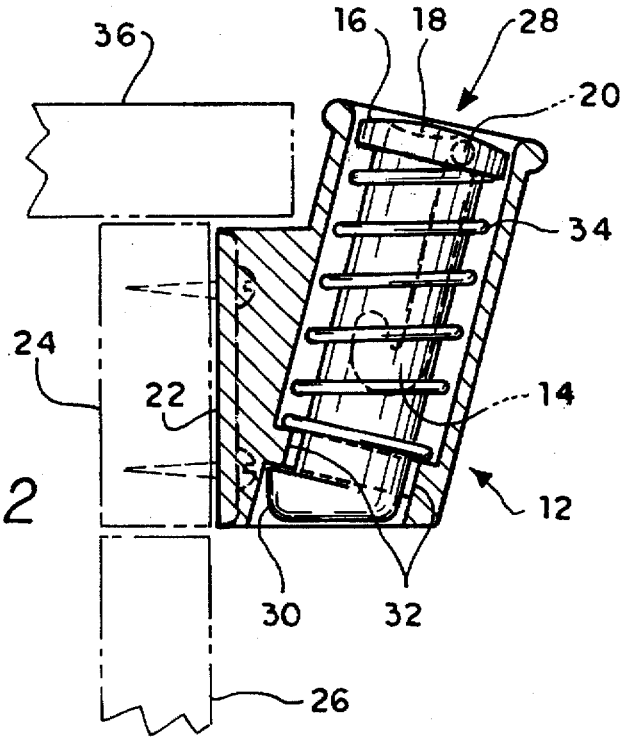
FIG. 2 is an environmental elevational view of the child resistant tube latch, with the guard tube in cross-section, showing the deadbolt in an unlocked position.
Figure 3:
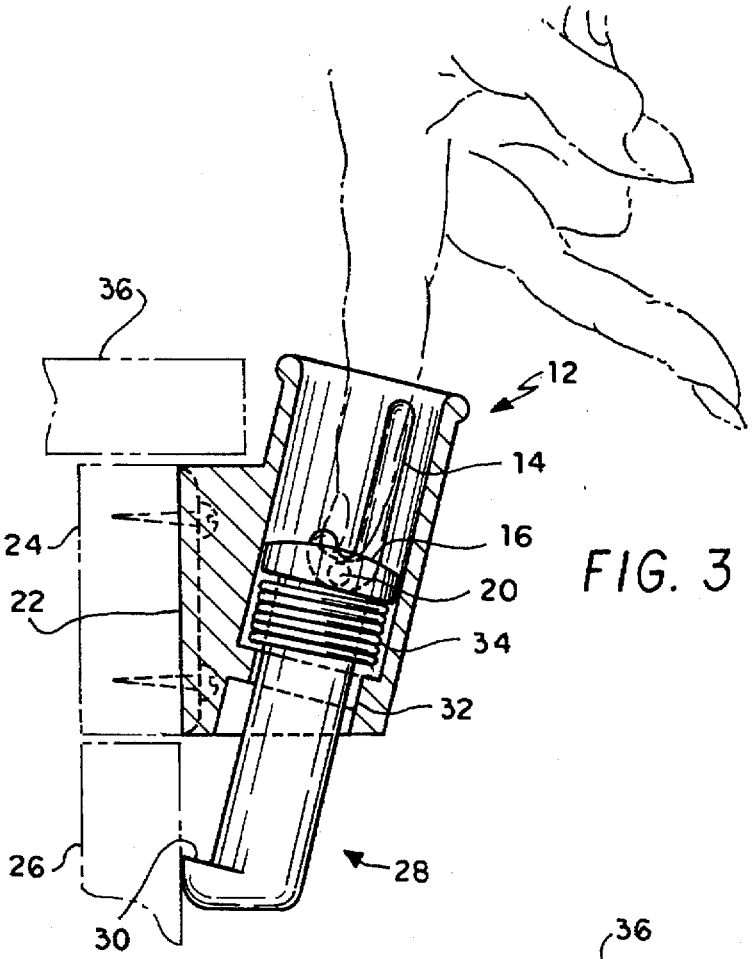
FIG. 3 is an environmental elevational view of the child resistant tube latch, with the guard tube in cross-section, showing the deadbolt in a position between locked and unlocked and the spring in a fully compressed position.
Figure 4:
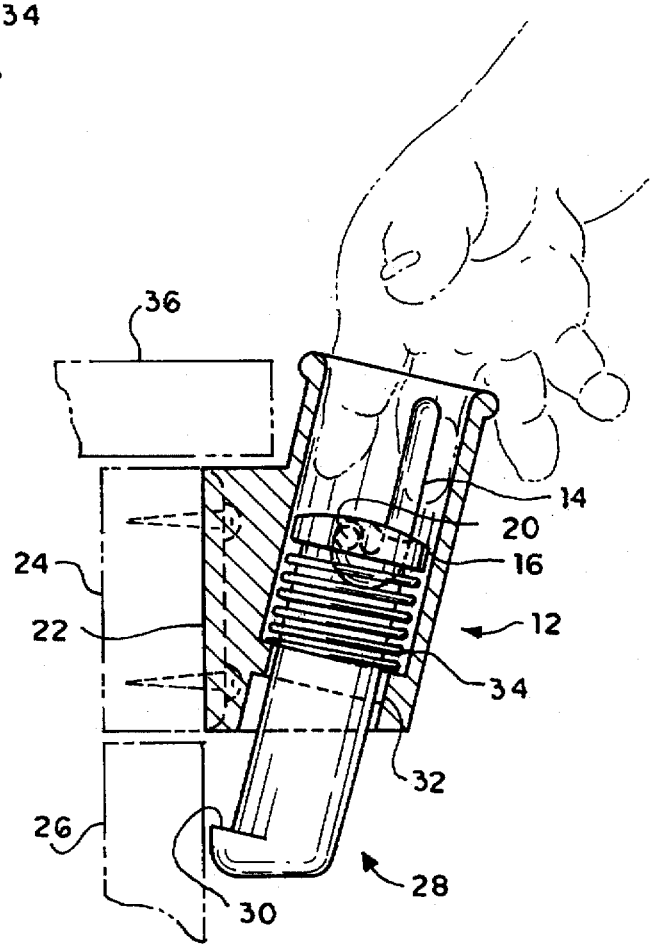
FIG. 4 is an environmental elevational view of the child resistant tube latch, with the guard tube in cross-section, showing the deadbolt in a locked position.

The latch 10 includes a deadbolt 28 (best seen in FIGS. 2&4). The deadbolt 28 includes a button 16 for actuating, i.e. pushing down, the deadbolt 28. The button 16 has a pair of locking pins 20, 20 which fit into the locking pin guides 14, 14. The button 16 is planar and has an indentation 18 on its upper surface for receiving a finger. As will be discussed in conjunction with FIG. 3, the indentation 18 provides a means for a finger to push the button 16 and to twist the deadbolt 28 to determine whether it will be locked. The upper surface of the button 16 is red, or any other color, to provide a warning when the deadbolt 28 is unlocked.

Referring to FIG. 2, the deadbolt 28 is in an unlocked position and the locking pins 20, 20 are biased against the upper portion of the longer portion of the guides 14, 14. The body of the deadbolt 28 is enclosed by a spring 34. The spring 34 has a smaller area than the button 16; therefore when the button 16 is actuated, the spring 34 is compressed against a ridge or protrusion 32 in the guard tube 12. The ridge 32 allows the deadbolt 28 to pass through to the lower portion of the guard tube 12. However, a lip 30 on the lower end of the deadbolt 28 makes it greater in area than the area of the guard tube 12 at the point of ridge 32. This lip 30 maintains the lower end of the deadbolt 28 below the ridge 32, resulting in the button 16 remaining below the top of the guard tube 12.

FIG. 3 shows the deadbolt 28 in a position between locked and unlocked. The button 16 is pushed all the way down and the spring 34 is fully compressed against the ridge 32 in the guard tube 12. The locking pins 20, 20 are in the lowest point of the J-shaped guides 14, 14. As the finger releases the button 16, the locking pins 20, 20 will be forced to the upper portion of either of the shorter or longer portions of the guides 14, 14 by the spring 34. Slight urging in a clockwise direction will cause the locking pins 20, 20 to be guided into the longer portion of the guides 14, 14 and result in the deadbolt 28 becoming unlocked.

A counterclockwise rotation will cause the locking pins 20, 20 to be guided into the shorter portion of the guides 14, 14 and result in the deadbolt 28 becoming locked. In this position the locking pins 20, 20 are biased against the upper portion of the shorter portion of each of the guides 14, 14.

The deadbolt 28 blocks the cabinet door 26 when it is in a locked position, as seen in FIG. 4. When the cabinet door 26 is blocked by the deadbolt 28, the only manner in which to open the door 26 is by releasing the deadbolt 28. Because the deadbolt 28 is below the top of the guard tube 12 when in the locked position, the deadbolt is accessible only to those with fingers long enough to reach the button 16. For example, the adult's finger in FIG. 3 can reach the button 16 while the child's fingers cannot, as seen in FIG. 4. Thus, chidren will be thwarted in their attempt to gain access to a cabinet protected by the instant invention.

It is noted that the latch being in an upright position, as seen in the attached drawings, is merely preferred and is not the only orientation in which the latch can be used. Regardless of the orientation of the latch, it will prevent those with relatively small fingers, i.e. children, from actuating the deadbolt 28 as it is in an inaccessible position when it is locked.

It is to be understood that the present invention is not limited to the sole embodiment described above, but encompasses any and all embodiments within the scope of the following claims.

I claim:

1. A child-resistant latch comprising:

a coiled spring;

a locking mechanism disposed within said coiled spring, said locking mechanism having actuation means at one end and a lip at the other end;

a guard tube housing said spring and said locking mechanism and including a pair of J-shaped tracks for guiding said locking mechanism into a locked position said guard tube further including a ridge disposed above said lip, said ridge biasing said spring when said mechanism is guided into a locked position; and mounting means for mounting said guard tube to an exterior surface adjacent a door or drawer to be locked.

2. The latch of claim 1 wherein said actuation means is a button.

3. The latch of claim 2 wherein said button is substantially planar and includes means defining an indentation on an upper surface of said button.

4. The latch of claim 1 wherein said locking mechanism includes at least one locking pin.

5. The latch of claim 1 wherein said means for guiding includes at least one track being integral with said guard tube.

6. The latch of claim 1 wherein said locking mechanism is a deadbolt.

7. A child-resistant latch comprising:

a round, coiled spring defining a coiled area;

a deadbolt having a body, a first end on one side of said body and a second end on another side of said body, said body being within said coiled area of said spring, said first end of said deadbolt having a button and a pair of locking pins, periphery of said button being larger than a periphery of said spring such that said button is external of said coiled area of said spring and compression of said button results in compression of said spring;

a guard tube housing said spring and said deadbolt, said guard tube having a pair of locking pin guides in which said pair of locking pins are guided and caused to lock, said guard tube including a ridge which reduces the area of said guard tube at the point of said ridge to less than an area of said spring, such that said spring can be compressed against said ridge; and mounting means for mounting said guard tube to a surface adjacent a door or drawer to be locked.

8. The latch of claim 7 wherein said second end of said deadbolt has a lip and is extended past said ridge in said guard tube, said second end of said deadbolt being larger in area than said guard tube at the point of said ridge, such that said second end of said deadbolt remains past said ridge on deactivation of said button.

9. The latch of claim 7 wherein said button is substantially planar and includes means defining an indentation on its upper surface.

10. The latch of claim 9 wherein said pair of locking pins are protrusions on either side of said button.

11. The latch of claim 7 wherein said each of said locking pin guides includes at least a long and a short portion and said locking pins are spring-biased against said long portion when said latch is in an unlocked position and spring-biased against said short portion when said latch is in the locked position.

12. The latch of claim 11 wherein said locking pin guides are J shaped.

13. The latch of claim 7 wherein said locking pin guides are J shaped.

* * * * *